US007073654B2

(12) United States Patent
Matubara et al.

(10) Patent No.: US 7,073,654 B2
(45) Date of Patent: Jul. 11, 2006

(54) COIN SELECTOR FOR BIMETAL COINS

(75) Inventors: Yukinari Matubara, Iwatsuki (JP); Hiroshi Ohtomo, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 355 days.

(21) Appl. No.: 10/384,017

(22) Filed: Mar. 7, 2003

(65) Prior Publication Data

US 2003/0209402 A1 Nov. 13, 2003

(30) Foreign Application Priority Data

Mar. 11, 2002 (JP) ..... 2002-066036

(51) Int. Cl.
*G07D 7/00* (2006.01)
*A44C 21/00* (2006.01)
*G06C 29/00* (2006.01)

(52) U.S. Cl. ..... 194/318; 194/303; 194/320; 194/335; 194/334

(58) Field of Classification Search ..... 194/334–338, 194/302, 303, 317–320; 702/170, 97; 324/662, 324/699, 222; 250/559; 177/50, 51; 73/163, 73/514.14

See application file for complete search history.

(56) References Cited

U.S. PATENT DOCUMENTS

| | | | | | |
|---|---|---|---|---|---|
| 4,546,869 | A * | 10/1985 | Dean et al. | ..... | 194/303 |
| 4,742,903 | A * | 5/1988 | Trummer | ..... | 194/317 |
| 4,971,187 | A * | 11/1990 | Furuya et al. | ..... | 194/318 |
| 5,033,603 | A * | 7/1991 | Kai et al. | ..... | 194/334 |
| 5,158,166 | A * | 10/1992 | Barson | ..... | 194/319 |
| 5,263,566 | A * | 11/1993 | Nara et al. | ..... | 194/318 |
| 5,337,877 | A * | 8/1994 | Waite et al. | ..... | 194/317 |
| 5,489,015 | A * | 2/1996 | Wood | ..... | 194/318 |
| 5,871,075 | A * | 2/1999 | Takayama et al. | ..... | 194/318 |
| 6,196,371 | B1 * | 3/2001 | Martin et al. | ..... | 194/317 |
| 6,250,453 | B1 * | 6/2001 | Furuya | ..... | 194/317 |
| 6,398,001 | B1 * | 6/2002 | Hutchinson et al. | ..... | 194/317 |
| 6,539,083 | B1 * | 3/2003 | Churchman | ..... | 379/146 |

* cited by examiner

*Primary Examiner*—Gene O. Crawford
*Assistant Examiner*—Jeffrey A. Shapiro

(57) ABSTRACT

A coin selector assembly includes a coin passageway having at least a pair of thickness sensor unit operatively positioned along the coin passageway to provide respective measurements of the thickness of the coin. A comparing unit compares the respective thickness signals with corresponding stored standard values representative of a genuine coin to determine the authenticity of the coin. Additional sensor unit can be positioned along the coin passageway and excited with different frequencies. Thus, a material sensor unit and a diameter sensor unit or a pair of diameter sensor unit can also be utilized.

3 Claims, 4 Drawing Sheets

COIN SELECTOR FOR BIMETAL COINS

BACKGROUND OF THE INVENTION

1. Field of the Invention

This invention is related to a coin selector which accurately judges whether a coin is genuine or false by increasing a distinguishing accuracy of measuring the thickness of a coin and more particularly is suitable for bimetal coins which are made up of different material either at the center or the rim of the coin.

2. Description of Related Art

Coin selectors which distinguish between genuine and false coins have used a material detecting coil, a thickness detecting coil and a diameter detecting coil located along a coin passageway such shown in as Japan laid-open patent application 200-187746. The thickness detecting coil and the material detecting coil are located relatively to the center of the coin and the diameter detecting coil is located relatively to the rim of the coin.

Therefore, the thickness of a false coin with comparable material and diameter may pass through, because machining a false coin's center is easy to do. To prevent such false coins, a bimetal coin which has a circular center fitted into a rim ring has been suggested.

Accordingly, the center disc and the rim ring are made up of different material. Therefore, distinguishing of the coin's material can increase the accuracy. However, the prior art cannot increase such accuracy when a thickness sensor unit is located to refer to the center of the coin.

When a coin uses the same center material and rim material, it is difficult to distinguish authenticity.

U.S. Pat. No. 4,323,148 represents one approach to distinguish false coins.

The prior art is still seeking to improve coin selectors.

SUMMARY OF THE INVENTION

The present invention provides a coin selector which can measure a thickness parameter at a plurality of different positions on a coin including the center and rim. The coin selector further is compact and measures both material parameters and diameters of coins.

The coin selector of the present invention utilizes sensor units located along a coin passageway in which coins are guided by a guiding rail pass a plurality of thickness sensor units. Thus, the thickness of the coin can be measured at a plurality of positions. The coin's thicknesses are determined through this plurality of measurements. The thickness sensor units include a first thickness sensor unit located relative to the center of the coin as it moves and a second thickness sensor unit located relative to the rim of the coin. The output measurements from these sensor units can be compared to the values of a genuine coin which is used as a pre-stored standard value. In addition, the first thickness sensor unit and the second thickness sensor unit are located along a line which will cross a guiding rail. It can be arranged that the first thickness sensor unit and the second thickness sensor unit can measure the thickness of the same diameter positions at the same time. The first thickness sensor unit can face the center of the coin and the second thickness sensor unit can face the rim. Even if the diameter of the coin differs, accurate measurements can be made. In addition, material sensor units and diameter sensor units can be located close to the first thickness sensor unit and the second thickness sensor unit. By making comparisons of known values for the coin material that should be expected and the diameter parameters, further verification of the authenticity of the coin can be achieved. The individual sensor units can be made up of coils and by appropriate arrangement of the material sensor unit, frequency, interference with the output of the other sensor unit coils can be prevented and the coin selector can be formed in a very compact and cost-effective manner while increasing the accuracy of detection.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

It should be understood that the term "Coin" can refer to numerous different forms of tokens, medallions and monetary denominations of value. Unless otherwise described herein, our present example is directed to a bimetal coin.

Figure 1:
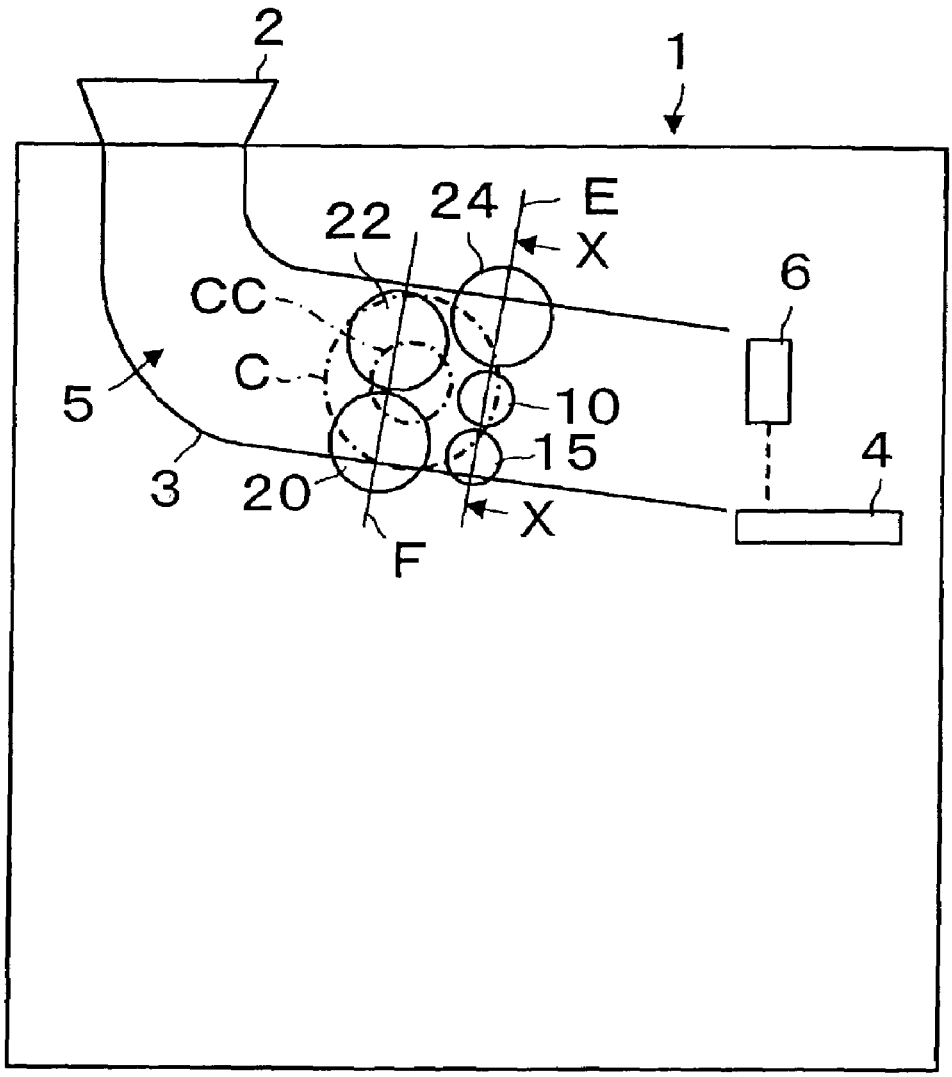
FIG. 1 is a schematic overall view of the present invention.

The structure of the coin selector of the present invention is shown in FIG. 1 and includes a housing having a box-like configuration that is adapted to being installed or built into a vending machine or other coin receptive apparatus. A coin C can be inserted within a coin slot 2 to roll on a guiding rail 3 which is slanted and can transport the coin to an exit gate 4. Thus the coin C will move along the coin passageway formed by the guiding rail 3.

The gate 4 can be moved by a gate solenoid unit 6 shown in a schematic configuration. When the solenoid 6 is not excited, the gate is located at a closed position away from the axis of the guiding rail 3. In this situation, the coin is directed to a returning slot. When solenoid 6 is excited, gate 4 is moved to an open position, and the coin C is guided into a safe (not shown).

The first thickness sensor unit 10 is located besides the coin passageway 5 and is positioned a predetermined distance away from the guiding rail 3. Preferably this position is located adjacent to the center section CC for the plurality of coins as they will travel along the passageway 5.

Figure 2:
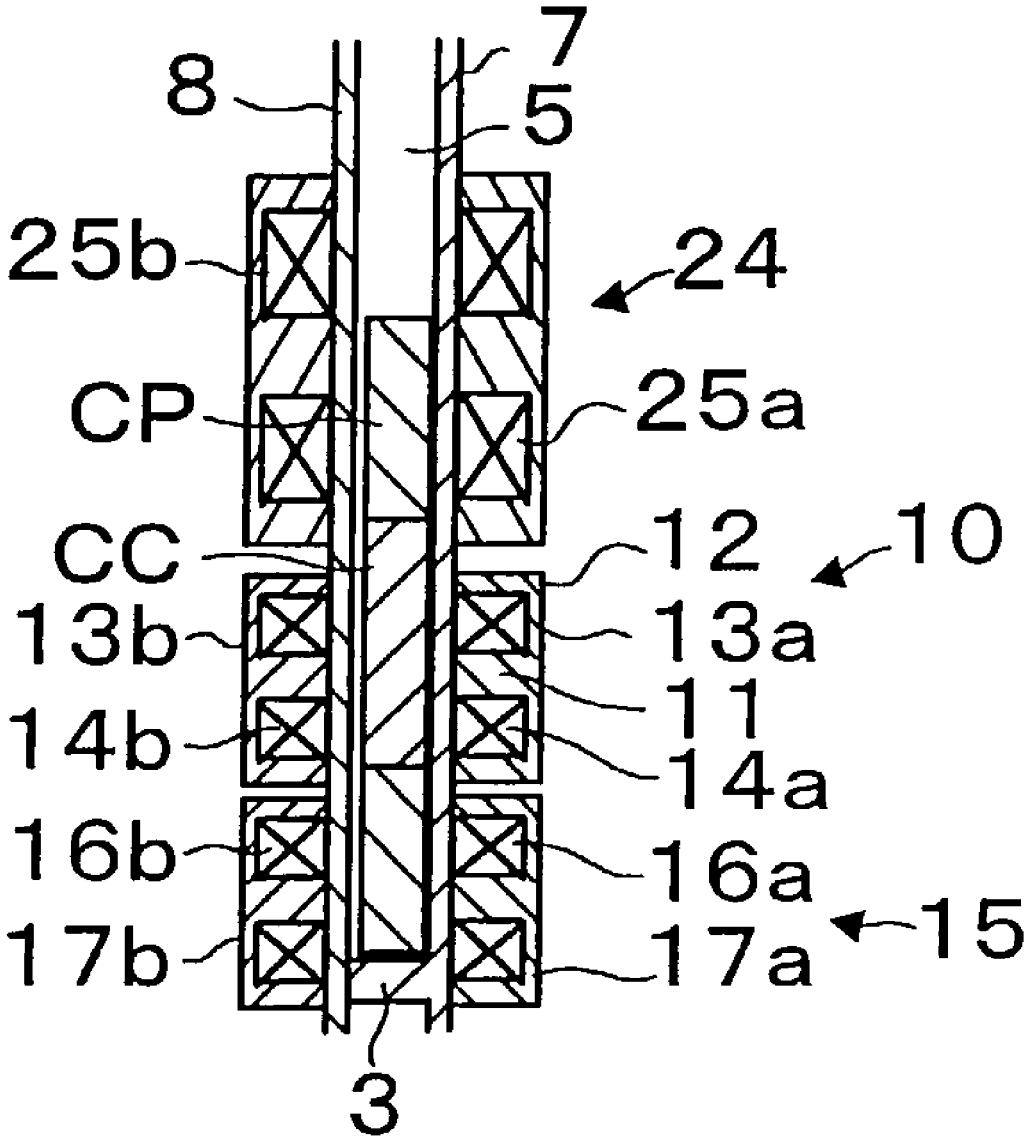
FIG. 2 is a partial cross-sectional view taken along the line E in FIG. 1.

Referring to FIG. 2, the first thickness sensor unit 10 includes a pair of ferrite members 13*a* and 13*b* which are located respectively at the left and right side of the coin passageway. Ferrite member 13*a* has a cylindrical binding or core section 11 which is located at the center with a flange that is located around the binding section 11 to provide a pan head shape. An appropriate coil 14*a* is wound about the binding section 11.

Ferrite member 13*b* has the same configuration as ferrite member 13*a* and includes a coil 14*b*. The end face of the binding section II is positioned to face the center section CC so that the magnetic flux is focused into the binding section 11. Ferrite member 13*a* is fixed at the exterior wall of side board 7. First thickness sensor unit 10 can be structured by either the coils 14*a* or 14*b*.

The second thickness sensor unit 15 is located nearer the guiding rail 3 than the first thickness sensor unit 10. This position can be referred to as the "rim CP of coin C". The structure of the second thickness sensor unit 15 is of the same configuration as the first thickness sensor unit 10. Accordingly, the second thickness sensor unit 15 includes a ferrite member 17*a* with a coil 16*a* wound there around and a ferrite member 17*b* with a coil 16*b* wound there around.

The binding section 11 of ferrite members 17*a* and 17*b* are located by referring to the rim section CP. The centers of the first thickness sensor unit 10 and the second thickness sensor unit 15 are located on a line E which crosses the guiding rail 3 at a right angle. Coils 14*a* and 14*b* of the first thickness sensor unit 10 and coils 16*a* and 16*b* of the second thickness sensor unit 15 are added to receive a high frequency wave.

The first thickness sensor unit 10 is located facing the center section CC of the coin while the second thickness sensor unit 15 is located to face the rim section CP of the coin. The respective sensor units have a function of measuring a parameter relating to the thickness of the coin. Alternative configurations of sensor units can be used as long as they can provide this function. It is also possible to increase the thickness sensor units to be three in number.

A material sensor unit 20 is located facing the coin passageway 5 and is located slightly upstream from the first thickness sensor unit 10 as shown in FIG. 1. The structure of the material sensor unit is basically the same as the first thickness sensor unit 10. Accordingly, it has a ferrite member whose coil 21 is wound around the ferrite member while a coil 21*b* is wound around another ferrite member. The diameters of the coils 21*a* and 21*b* are larger than the diameters of the coils 14*a* and 14*b* of the thickness sensor unit 10. Other forms of material sensor units can be utilized as long as they are capable of determining a parameter that is a characteristic of the material of the coin.

The first diameter sensor unit 22 is located at a further position from the guiding rail 3 than the material sensor unit 20. The first diameter sensor unit 22 has coils 23*a* and 23*b*, and the structure and scale of these coils are the same as the material sensor unit 20. The centers of the material sensor unit 20 and the first diameter sensor unit 22 are located on a straight line F which crosses the guiding rail 3 at a right angle.

A second diameter sensor unit 24 is located on line E and is located further away from the guiding rail 3 than the first thickness sensor unit 10. The second diameter sensor unit 24 has coils 25*a* and 25*b*, and the structure and scale of these coils are the same as the first diameter sensor unit 22. The second diameter sensor unit 24 is located further away from the guiding rail 3 than the first diameter sensor unit 22.

While it is possible to have a measurement of the diameter by utilizing only a first diameter sensor unit 22, it is preferable to have a second diameter sensor unit 24 because it can pick up differences between coin diameters and thereby increase the accuracy of the measurement. Thus, by using a pair of diameter sensor units, smaller coins are distinguished based on the output of the first diameter sensor unit 22 while larger coins are distinguished based on the output of the second diameter sensor unit 24. It is possible to use other forms of sensor units as long as the function of measuring diameter is achieved.

Since the plurality of sensor units can be located on straight lines, they can be positioned in generally a smaller area to thereby permit the coin selector of the present invention to be compact and small. Since the first thickness sensor unit 10 and the second thickness sensor unit 15 can be identical, while the material sensor unit 20 and the first diameter sensor unit 22 and the second diameter sensor unit 24 can be the same, it is possible to mass produce the sensor units to make them inexpensive when manufactured in large quantities.

Figure 3:
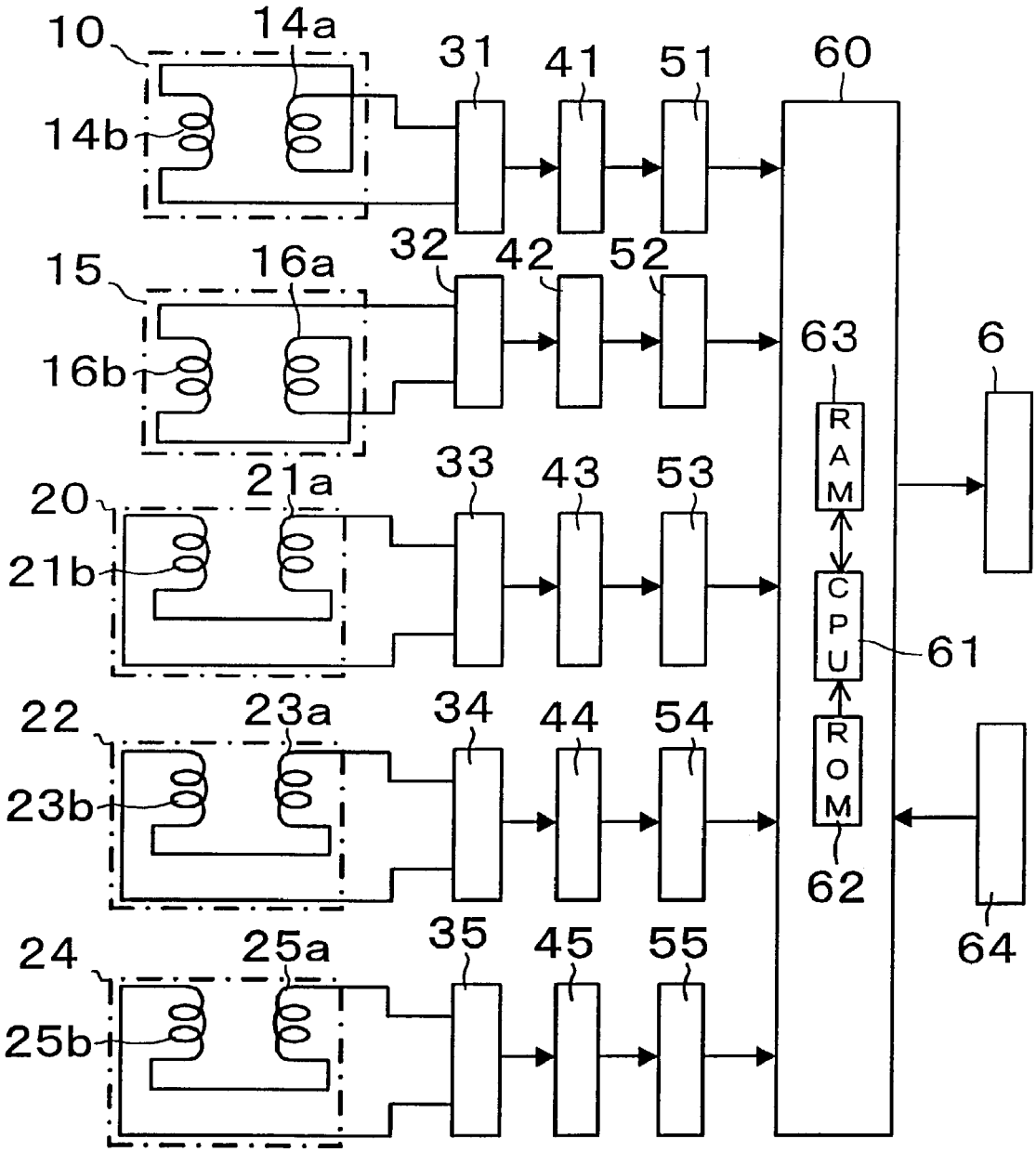
FIG. 3 is a schematic block diagram of a coin selector of the present invention.

Referring to FIG. 3, a control block diagram is illustrated. Coils 14*a* and 14*b* of the first thickness sensor unit 10 are differentially connected and are further connected to an oscillating circuit 31. The oscillating circuit in turn is connected to a detection circuit 41 which is connected to an A/D conversion device 51 to provide an input into a port of the microprocessor 60. The oscillating circuit 31 has a capacity of providing a relatively high frequency. Coils 16*a* and 16*b* of the second thickness sensor unit 15 are differentially connected and are in turn connected to the oscillating circuit 32. The oscillating circuit is connected to a detection circuit 42 and to an A/D conversion device 51 which is connected to a port of the microprocessor 60. The oscillation frequency of the oscillation circuit 32 also is a high frequency.

Coils 21*a* and 21*b* of the material sensor unit 20 are cumulatively connected and are connected to an oscillating circuit 33. The oscillating circuit 33 is connected to a detection circuit 43 and an A/D conversion device 53 is connected to a port of the microprocessor 60. The oscillating circuit 33 has a relatively low frequency output.

Coils 23*a* and 23*b* of the first diameter sensor unit 22 are cumulatively connected and are connected in turn to an oscillating circuit 34 of a relatively low frequency. The oscillating circuit 34 is connected to the microprocessor 60 through the detection circuit 44 and an A/D conversion device 54.

Coils 25*a* and 25*b* of the second diameter sensor unit 24 are cumulatively connected and are connected to a low frequency oscillating circuit 35. Oscillating circuit 35 is connected to the detection circuit 45 and an A/D conversion device 55 which in turn is connected to a port of the microprocessor 60.

By appropriate setting the frequency of the oscillation circuits, it is possible to prevent any interference in the frequencies between the sensor units. Because the sensor units are located relatively close, the low frequency oscillating circuit of the material sensor unit 20 is initially set up to a frequency value where the largest variation of voltage refers to the desired coin material. Next, the frequency value of the first thickness sensor unit 10 is set up because the parameter of the center of the coil is larger.

Then the frequency of the first diameter sensor unit 22 is set and then the frequency of the second diameter sensor unit is set up. Finally, the frequency of the second thickness sensor unit 15 is set up. Frequency interference will not occur because the first thickness sensor unit 10 and the second thickness sensor unit 15 are differentially connected, and the material sensor unit 20, first diameter sensor unit 22 and the second diameter sensor unit 24 are cumulatively connected.

The microprocessor system 60 includes a CUP 61 and ROM 62 and a RAM 63. An appropriate computer program can be stored in the ROM 62 and can be executed by the CUP 61 while communicating with the RAM 63. The microprocessor system can take the input from the various sensor units to distinguish between a genuine and a false coin. When the coin is determined to be genuine, the solenoid 6, shown in FIG. 1, is excited at a predetermined time period so that the coin C can be passed to the safe.

In operation, when the coin C rolls on the guiding rail and passes through the material sensor unit 20, and the first diameter sensor unit 22, it generates characteristic output signals. The coin then proceeds to pass through the first thickness sensor unit 10, the second thickness sensor unit 15 and the second diameter sensor unit 24 to also produce appropriate output signals.

Figure 4:
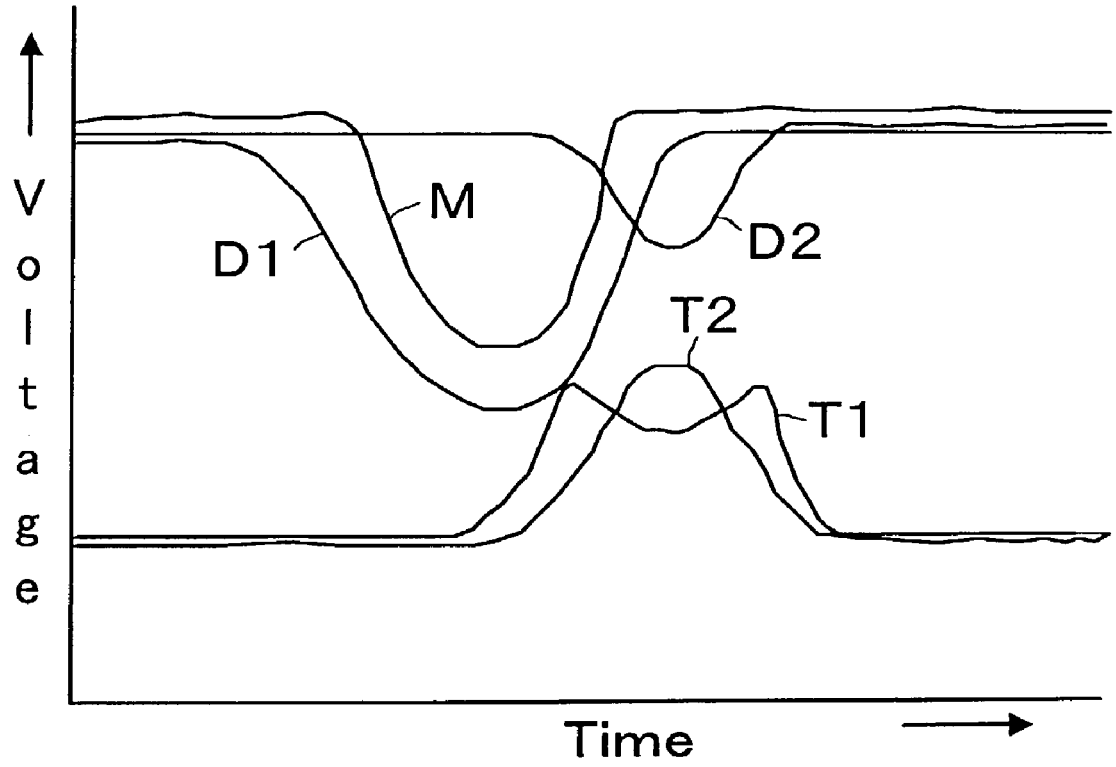
FIG. 4 is a diagram of Voltage versus Time to illustrate measurement signals of the present invention.

As the coin passes through the position of the first diameter sensor unit 22, the magnetic field of the sensor unit 22 experiences the effect of the presence of the coin C. Accordingly, the output voltage of the detecting circuit 41 is reduced as shown in FIG. 4, line D1. The analog signal from the detecting circuit is converted into a digital signal by the A/D converting circuit 54 and is input into the microprocessor 60.

The magnetic field of the material sensor unit 20 receives the effect of coin C and the output of the detecting circuit 43 is reduced as shown in line M. Again, the output signal is converted into a digital signal and is inputted to the microprocessor 60.

The magnetic field of the first thickness sensor unit 10 receives the effect of the center section CC of coin C and the output of the detecting circuit 41 changes as shown in line T1. The middle section of line T1 is concave because the material differs at the center section CC from the rim section CP.

The magnetic field of the second thickness sensor unit 15 receives the effect of the rim section CP of coin C and the output of the detecting circuit 42 changes as shown on line T2. The magnetic field of the second diameter sensor unit 24 receives the effect of the rim section CP of coin C and the output of the detecting circuit 45 changes as shown in line D2.

When a coin's diameter is smaller, it may not change the output because the sensor unit does not face the coin C. In this situation, the diameter can be distinguished by only the output signal of the first diameter sensor unit 22 and not that of the second diameter sensor unit 24.

As can be readily appreciated, the characteristic output lines of voltage over time for each of the respective sensor units can be compared to a standard quantity from a standard setting circuit 64. When the output quantity is within the range of the standard quantity, the program can go to a second step and can correspondingly make a comparison for each of the signal outputs relative to standard quantities. Thus, the output of the first diameter sensor unit 22, line D1, is compared in the second step and then the program passes to the third step where the output quantity of line D2 of the second diameter sensor unit is compared with the standard quantity.

When that standard quantity is within the predetermined range of the standard quantity, the program then proceeds to a fourth step where the output quantity line T1 of the first thickness sensor unit 10 is compared to a standard quantity. If it is also within the range of the standard quantity, the program then proceeds to a fifth step where the output quantity line T2 of the second thickness sensor unit 15 is compared to the standard quantity. If the output quantity of each of the sensor units is in the range of the standard quantities for the comparison step, the coin is then considered to be distinguished as genuine and a solenoid 6 is excited to thereby move the gate 4 and enable the storage of a genuine coin.

If, however, an output quantity is out of the range of the standard quantity at any one of the steps, the coin is then considered to be false and therefore the solenoid 6 is not excited. The coin is then indicated to be false and the solenoid 6 is not excited so that the coin C will pass beyond gate 4 and be returned without enabling the vending machine.

In the above specification, the terminology "high frequency" and "low frequency" are relative expressions and a person of skill in this field can select the appropriate values while avoiding interference.

When the first thickness sensor unit 10 and the second thickness sensor unit 15 are coils as shown in the embodiment of the present invention, the output signals can be affected by the materials. However, the effected materials are drastically smaller than the effect of thickness. Therefore, these sensor units can be effective thickness sensor units. The material sensor unit can also be located relative to the rim section and the center section of the coin. It can be appreciated that the shape of a coil can be changed to triangular or rectangular, etc.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin selector assembly having a coin passageway camprising:

a guiding rail defining a supporting surface for translating a coin along the coin passageway;

a first thickness sensor unit, having a predetermined coil diameter, positioned adjacent a center of the coin passageway above the guiding rail, for measuring a first thickness adjacent a center of the coin and providing output signal;

a second thickness sensor unit, having the same predetermined coil diameter as the first thickness sensor and positioned offset from the first thickness sensor unit along a line which crosses the supporting surface of the guide rail for measuring a second thickness adjacent a rim of the coin and proving an output signal, wherein the centers of the first thickness sensor unit and the second thickness sensor unit are aligned on an axis perpendicular to the coin passageway to measure at the same time period the coin translating on the guiding rail;

a material sensor unit, having a predetermined coil diameter larger than the first thickness sensor, located on the coin passageway, upstream from the first thickness sensor unit, for measuring the material of the coin and providing an output signal, wherein the second thickness sensor unit and the material sensor unit are positioned within a plane containing the supporting surface of the guiding rail;

a first diameter sensor unit, having the same coil predetermined diameter as the material sensor unit, located adjacent the material sensor and above the guiding rail for measuring smaller coins and providing an output signal;

a second diameter sensor unit, having the same coil predermined diameter as the material sensor unit, located further away from the guide rail than the first diameter sensor unit for measuring larger coins than the smaller coins and providing an output signal; and a comparing unit for comparing sensor output signals with respective corresponding standard value representations of a genuine coin to determine the authenticity of the coin.

2. The coin selector assembly of claim 1 further including an oscillating frequency assembly to provide different frequencies to each sensor unit to minimize interference.

3. The coin selector assembly of claim 2 wherein the oscillating frequency assembly provides relative higher frequency waves to the first and second thickness sensor units and relaively lower frequency waves to the material sensor unit.

* * * * *